United States Patent [19]

O'Brian

[11] Patent Number: 4,753,439

[45] Date of Patent: Jun. 28, 1988

[54] MESSAGE TYPE RECORDING PSYCHOGRAPHS

[76] Inventor: Edward D. O'Brian, 2125 Falmouth Ave., Anaheim, Calif. 92801

[21] Appl. No.: 786,240

[22] Filed: Oct. 10, 1985

[51] Int. Cl.[4] ..... A63F 3/00

[52] U.S. Cl. ..... 273/161; 273/238; 273/239; 434/168; 434/169; 434/202

[58] Field of Search ..... 273/161, 238, 239; 434/159, 161, 168, 169, 176, 202, 330

[56] References Cited

U.S. PATENT DOCUMENTS

| | | | |
|---|---|---|---|
| 1,400,791 | 12/1921 | Bigelow | 273/161 |
| 1,418,686 | 6/1922 | Swallow | 273/161 |
| 2,220,455 | 11/1940 | McCarthy | 273/161 |
| 2,838,847 | 6/1958 | Zalkino | 434/169 |
| 3,843,132 | 10/1974 | Ferguson | 273/238 |
| 4,371,167 | 2/1983 | O'Brian | 273/161 |
| 4,545,582 | 10/1985 | Andrews | 273/238 |
| 4,577,982 | 3/1986 | Sasaki | 400/17 |

FOREIGN PATENT DOCUMENTS

| | | | |
|---|---|---|---|
| 0046951 | 4/1977 | Japan | 273/238 |

OTHER PUBLICATIONS

Moon et al., *Wedge-The Extraordinary Communications of an Earthbound Spirit,* Llewellyn Publications, Minn., 1975, introduction to book and pp. 208 & 209.

*Primary Examiner*—Maryann Lastova

[57] ABSTRACT

A psychograph, of a type employing a movable indicator to designate indicia on a principal part of the device such as a board, can be constructed so that the indicator will cause a switch to close each time it points to or otherwise designates an indicia. A circuit is used to provide an output in the form of a signal capable of being stored or used by a computer, an electronic typewriter or the like when a switch is closed for a pedetermined time interval. Normally the board or similar part of the device will carry a plurality of indicia and a separate switch will be associated with each so that signals corresponding to all of the indicia can be obtained.

3 Claims, 4 Drawing Sheets

MESSAGE TYPE RECORDING PSYCHOGRAPHS

BACKGROUND OF THE INVENTION

The invention set forth in this specification pertains to new and improved psychographs of the type that are used so as to express a message or a similar type of communication. More specifically it pertains to what may be termed "recording psychographs" inasmuch as they are construced in such a way that a record can be made of any communication expressed as a result of the use.

Message type psychographs are commonly constructed so as to utilize a principal or primary member carrying at least one indicia and a secondary member or indicator which is adapted to be moved to designate the indicia in order to express a communication or message through what either is or may be considered to be body movement of one or more persons to designate the indicia. Most commonly the indicia used comprises a series of letters and numerals on the primary member. Frequently, simple words or phrases capable of being used as answers to many questions are employed either instead of or in addition to letters and/or words.

On occasion the indicia can comprise common elements of musical notation. Further, in some less common uses of message type psychographs the indicia can comprise such things as a map, a diagram of a circuit, an outline of a body, a photograph or the like. For reasons which will be apparent from a consideration of the remainder of this document, this invention is not concerned with psychographs in which a message or other communication is expressed by other than conventional words, numbers or other symbols capable of being reproduced or recorded in the normal manner of any conventional written communication.

Although it is known to use a mechanical structure to obtain a printout of a message type communication obtained as a result of the use of a psychograph all commonly known message psychographs are of such a character than any information designated by the indicator of the instrument pointing to one or more indicia must either be remembered by a person who is using or who witnesses the operation of the structure. This frequently causes difficulty, particularly when the indicator is moved so as to designate a series of indicia in rapid succession or when a comparatively long message is being designated. As a consequence of this type of problem some communications expressed by or through the use of a psychograph are on occasion lost while others are garbled.

BRIEF SUMMARY OF THE INVENTION

From this it will be apparent that there is a need for new and improved psychographs. More specifically there is a need for new and improved message type psychographs which are constructed so as to be capable of being used in recording any message obtained or achieved through the use of the psychograph. A prime objective of this invention is to provide new and improved psychographs to fulfill this need.

The invention is intended to provide psychographs which can be easily and conviently constructed at a comparatively nominal cost and which are capable of being used for prolonged periods with little or no maintenance. It is also intended to provide devices of the type indicated which can be used with a variety of computers, typewriter and other printers in providing a record of any message or communication obtained with a psychograph.

Further, an objective of the invention is to provide psychographs as previously indicated which are essentially nonmechanical in character. This later is considered important in avoiding the maintenance complications frequently encountered with mechanical printout structures and in minimizing the amount of body movement necessary to obtain a record of a message or communication. Since the physical forces normally employed to obtain planchette or other indicator movement in a psychograph are quite limited this last factor is significant.

In accordance with this invention the various objectives indicated in the preceding are achieved by providing in a psychograph having a primary member, at least one visually apparent indicia located on said primary member and an indicator which is adapted to be moved by one or more persons to designate the indicia in order to express a communication in which the improvement comprises: switch means located on said primary member in association with said indicia, actuating means for closing said switch means when said indicia is designated by said indicator, said actuating means being located on said indicator so as to be movable therewith, and circuit means for providing a signal capable of being used to obtain a record of said indicia being designated by said indicator, said circuit means being connected to said switch means.

BRIEF DESCRIPTION OF THE DRAWINGS

Because of the nature of this invention it is considered preferable to explain it in more detail by referring to the accompanying drawings in which.

Figure 1:
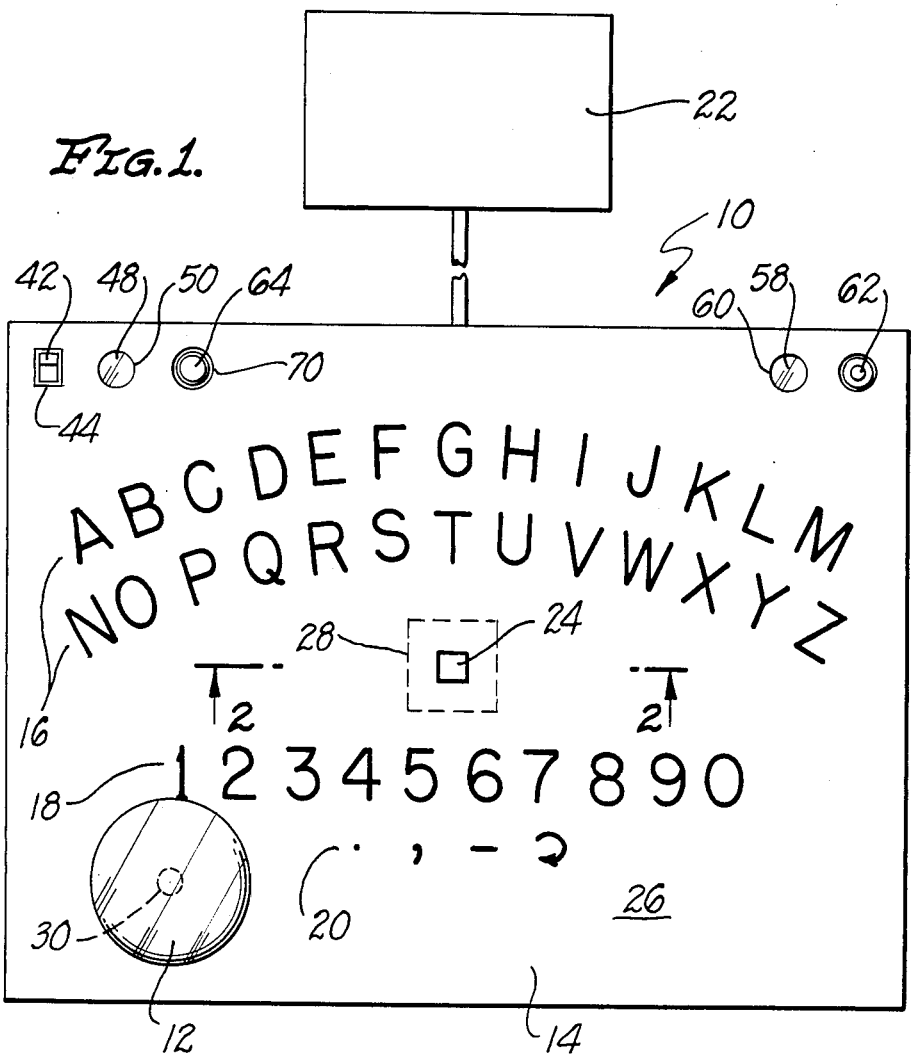
FIG. 1 is a top plan view of a presently preferred embodiment of form of a psychograph of this invention in which part of the primary member or board is obscured by the freely movable indicator or planchette employed with the psychograph.

The various psychographs illustrated are constructed so as to the utilize the operative concepts or principles of the invention as defined or summarized in the appended claims. It is considered self apparent that these concepts or principles can be easily embodied within other differently appearing and/or differently constructed psychographs than those illustrated through the use or exercise of routine engineering skill. For this reason the invention is not considered as being limited to psychographs corresponding to those shown in the drawings.

DETAILED DESCRIPTION

In the initial figure of the drawings there is shown a psychograph 10 of a type employing a freely movable indicator 12 in connection with a so-called board 14 which serves as a principal or primary member in order to support the indicator 12. Psychographs corresponding to the psychograph 10 were originally designated as "ouija" devices by E. J. Bond, the apparent inventor of this type of device. This particular word "ouija" may or may not be a trademark in a particular country. It is used in this specification merely because it is considered reasonably necessary to use it in order to adequately identify the subgeneric class of psychographs to which the psychograph 10 belongs.

In a traditional ouija type psychograph the board 14 is in fact a flat board which carries several rows of letters corresponding to rows 16 of the letters of the alphabet used on the board 14 and a line of arabic numerals corresponding to the line 18 of such numerals on the board 14. These rows 16 are preferably curved as shown as were the corresponding rows were in the original Bond device since this placement reasonably corresponds to the path the hands of an individual user of the psychograph take when the user's arms are at his or her sides as the indicator is moved on the board to designate successive letters and numbers.

In the original Bond structure the board also contained the words "yes", "no" and "good-bye". These have been omitted in the psychograph 10 in the interest of simplifying the device. If desired they and other words and phrases capable of serving as standardized responses to various inquiries can be used in addition to the rows 16 and 18 or instead of such rows 16 and 18. If desired the letters of the alphabet and the common numerals can be arranged in other manners than as shown such as, for example, in the manner in which they commonly appear on a typewriter keyboard. It is considered desirable to always locate the numbers and letters used in some sort of an order or pattern which will facilitate their being designated as the psychograph 10 is used.

Because of the manner by which a message or other communication is recorded as the psychograph 10 is used it is considered either necessary or at least highly preferable to use a line 20 of common punctuation marks containing such items as a comma, a period, a dash and the like. In general this line 20 should not contain more of such marks than are reasonably necessary to compose an understandable message in order to avoid making the psychograph 10 unnecessarily complex. If the psychograph is to be used with a printout or recording device 22 which will not automatically "wrap around" a message printed out so that it will continue on a successive line it is considered mandatory that a symbol indicating that a printout should continue on the next line such as the curved arrow (not separately numbered) should be incorporated in the line 20 or located elsewhere on the board 14. The use of the latter symbol is, of course, important in obtaining a long message in a common form.

The psychograph 10 also contains another symbol 24 which was not used in the original Bond device. This symbol 24 is intended to designate a space such as a space between words or after a period at the end of a sentence. The importance of this letter symbol is easily apparent. Without it a message or similar communication achieved would consist of words and/or numbers run together in a difficult to understand composite. It is considered that normally the symbol 24 will be used to a greater extent than any of the letters or numbers in the rows 16 and 18 and to a greater extent than any of the punctuation marks appearing in row 20.

Figure 2:
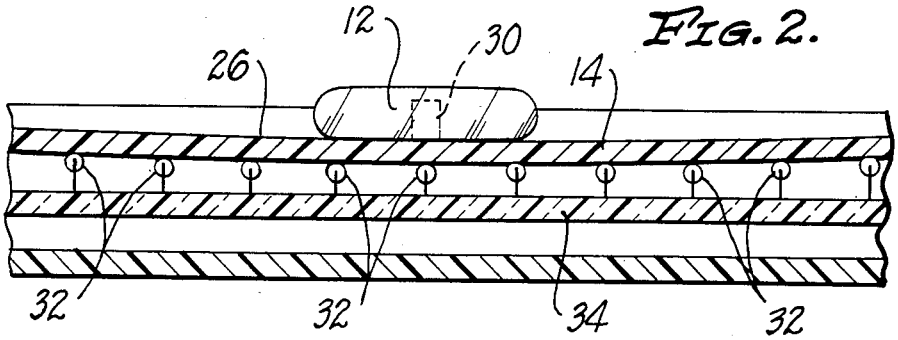
FIG. 2 is a view showing the indicator and a part of the board of the psychograph indicated in the preceding figure in an enlarged scale in section, the indicator being shown in this view in a position over the center of the board or primary member of the psychograph, the part of this view in section corresponding to a sectional view taken at line 2—2 of FIG. 1 with the indicator in a position as noted.

Because of this it is considered preferable to depart from the conventional flat configuration of the board 14 so as make the exposed or upper surface 26 of the board 14 of a curved, concave, "dished out" shape as noted in FIG. 2 so that the symbol 24 is located at the lowest area 28 of the surface 26 beneath the rows 16 and above the row 18 in about the center (not numbered) of the board 14. As a result of this configuration of the board 14 the hands of a user will tend to automatically locate the indicator 12 over the symbol 24 at the end of a series of movements designating a word or thought pattern. The fact that it is preferred that the board be curved as discussed does not mean that the board 14 cannot be flat in accordance with conventional practice.

The preferred indicator 12 illustrated differs from a pointed small table or planchette as used in the original Bond structure in several regards. Traditionally these planchettes were shaped so as to point toward a specific indicia designated as a psychograph was used. These planchettes were later modified without significantly changing the traditional shape of the planchette so as to include an opening through which an indicia being designated would be apparent. It is considered that such traditional, freely moving planchettes are not particularly suitable for cooncurrent use by several persons even though they have been so used. The indicator 12 used is preferably formed as a transparent circular disk having a curved, smooth, rounded perphery.

Various indicia as previously noted on the board 14 can be viewed through such as disc so that a user can know from visual inspection what indicia is designated at a specific time. The disc shape is intended to facilitate the indicator being concurrently engaged in a conventional manner by any desired number of persons as the psychograph 10 is used. A small magnet 30 is prefereably located in the center (not separately numbered) of the indicator 12 for the purpose of actuating magnetically operated switches 32 located on a circuit board 34 which is positioned beneath the board 14. If desired, this circuit board 34 can be considered to form a part of the board 14.

The magnet 30 also serves more or less as a pointer to visualy designate a specific indica as the psychograph is used. Preferably the magnet 30 is significantly smaller than the letters and numbers in the rows 16 and 18 so as to avoid these numbers and letters being obscured. It is considered that it is undesirable but still acceptable if a punctuation point such as a period is obscured by the magnet 30 since an error in punctuation will not normally effect the meaning of a communication to as great an extent as an error in the use of a letter or a number.

Figure 3:
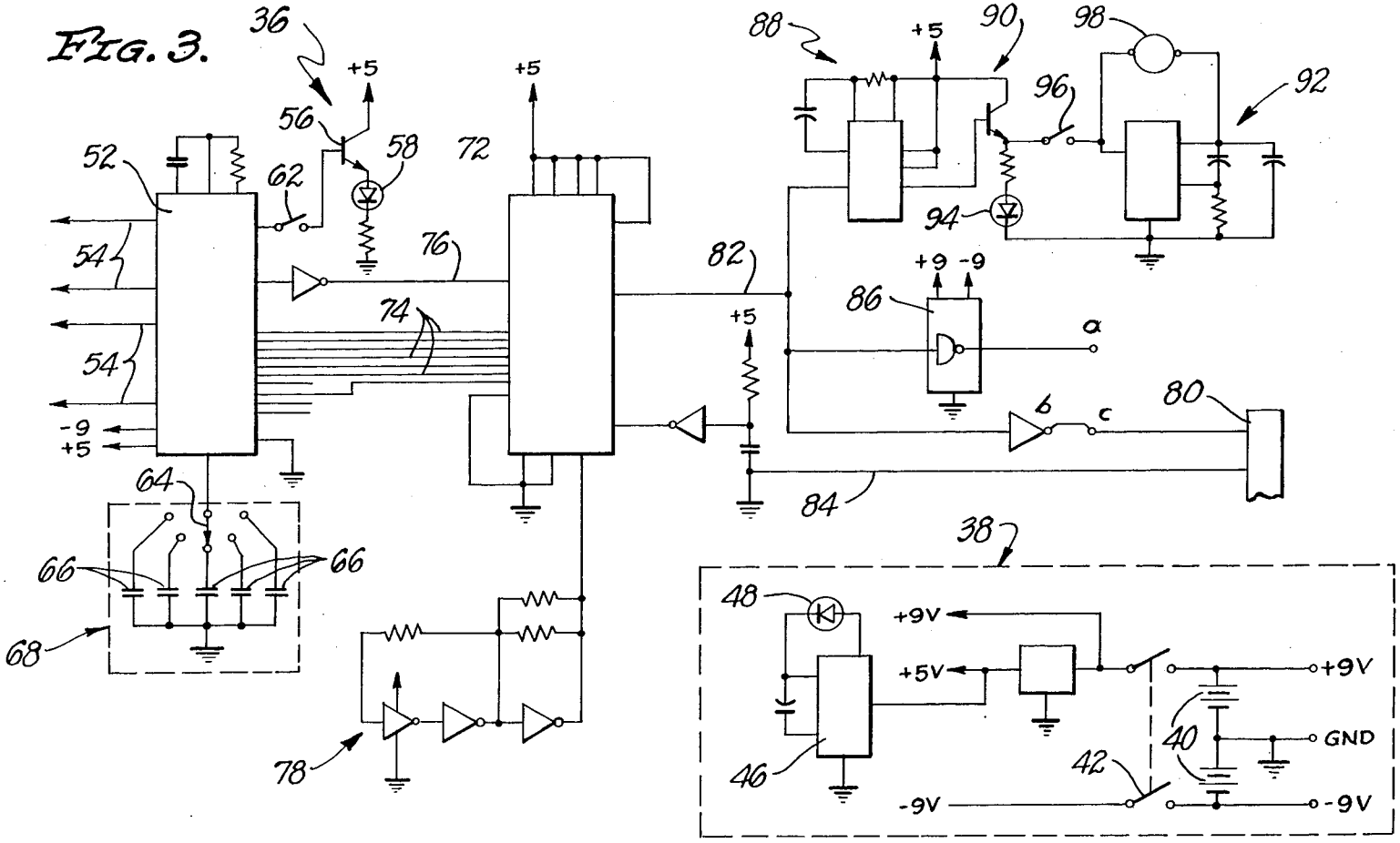
FIG. 3 is a circuit diagram of the circuit components (other then all of the switches) employed as a part of the psychograph.

One of these switches 32 is centrally located under each of the indicia in the rows 16, 18 and 20 as well as under the symbol 24. These switches are connected to and form a part of what may be referred to as "circuit means" 36 as indicated in FIG. 3. The entire circuit means 36 is mounted on the circuit board 34 in a conventional manner. It includes a power supply subcircuit 38 which is used to convert power from either an external source (not shown) or batteries 40 so as to supply the requisite voltages needed to operate various circuit components as hereinafter described. The batteries 40 are normally mounted on the board 34 so as to make the psychograph portable.

The subcircuit 38 includes a conventional on-off switch 42 which is located so as to be accessible through an opening 44 in the board 14. It further includes an oscillator chip 46 which is used to continuously flash a light emitting diode 48 when the switch 42 is closed so as to indicate that the psychograph 10 is in a condition to be used. This diode 48 is located so that it can be easily seen through another opening 50 in the board 14.

The subcircuit 38 is used to power or drive a conventional keyboard encoder 52. The latter is used to convert the signals obtained when the individual switches 32 are closed by the magnet 30 into conventional ASCII signals. The keyboard encoder 52 is connected to the individual switches 32 through various wires 54 in a conventional x-y matrix. It is connected to a transistor 56 so as to permit the operation of another light emitting diode 58 whenever one of the switches 32 is closed.

This diode 58 is located so as to be visible through another opening 60 in the board 14. The use of the diode 58 is considered to be desirable in providing a visual indication that a specific indicia has been identified through the use of the indicator 12. It is further considered that this is an optional feature which will be especially desirable when a person is learning to use the psychograph 10. If desired a conventional switch 62 can be used to prevent the diode 58 from being illuminated.

The keyboard encoder 52 is also connected to a further switch 64 which is used to ground the encoder 52 through any one of a series of capacitors 66 having successively greater (or lessor) capacitance values. This switch 64 and these capacitors 66 are considered important with the invention. Together they constitute an adjustable time delay circuit or means 68 which controls the operation of the encoder 52 so that the signal obtained by the encoder as a result of a switch 32 being closed has to be of a predetermined time duration before the encoder will supply an output signal.

This guards against the possibility of a letter or other indicia being erroneously designated as the indicator 12 is moved across one indicia while it is being moved to designate another, different indicia. Because the time interval obtained is independent of complications normally associated with mechanical components, this electronic circuit 68 is considered more reliable than any related mechanical delay. Further, the fact that the duration of the signal necessary to provide an output from the encoder 52 can be adjusted is believed important in adapting the operation of the psychograph 10 to the desires of a person operating it. The switch 64 is normally made accessible through another opening 70 in the board 14.

The encoder 52 is connected to a conventional parallel to serial converter or uart 72 through the usual series of wires 74 which are adapted to carry a coded signal and through a timing or strobe line 76. The vart 72 is connected to a conventional baud rate generator circuit 78 which is employed for the purpose of setting the rate of the output signals obtained from it. These signals are conveyed to a connector 80 used to drive the printout or recording device 22 through a serial output line 82 and a ground line 84.

Because a particular printout device 22 chosen for use with the initial psychograph 10 had an RS 232 drive port this line 82. contains an RS 232 converter 86. As shown the circuit means 36 does not use this converter 86 and provides a TTL output. When the converter 86 is used the terminals a and o are connected while the connection between terminal b and c is broken.

The printout or recording device 22 can be any device or structure which is capable of printing out any message or communication obtained through the use of the psychograph 10 at the time of such use or later, or of merely storing such a message or communication so that it may be reviewed after the psychograph is no longer being used. At present it is considered preferable for the printout 22 to be a common battery powered typewriter which is capable of being operated by the signals conveyed to it through the connector 80.

An audible indicator circuit 88 is preferably connected to the line 82 as shown so that when desired it can be used to provide an audible indication that a specific indicia has been designated using the indicator 12. The indication produced by this circuit 88 corresponds to the visual indication of the designation of an indicia provided by a diode 94 when the latter is used. This circuit 88 in effect has two parts- a conventional, pulse stretcher circuit 90 and a conventional oscillator 92. The diode 94 is a light emitting diode provided between them for giving a visual indication. Also a common switch 96 is used so as to control the operation of a common noise producing buzzer 98 driven by the oscillator 92.

It is considered that the use of the circuit 88 and the buzzer 98 is optional, but that in many cases their use will be desirable in assisting an individual to learn to use the psychograph 10. In this regard the buzzer 98 is related to the diode 94 previously described. Both are aids to the achivement of a desired manner of operation of the complete psychograph 10. Since the movement of the indicator 12 by one or more persons using the psychograph 10 is essentially the same as the movement of the planchette in any other psychograph having a freely movable indicator which is used in connection with indicia on a surface of a board or the like it is not considered to encumber this specification with a detailed discussion of the operation of this psyhograph 10.

Although it is not presently considered desirable because of the ease of use of psychographs corresponding to the psychograph 10 and because of the widespread acceptance of such psychographs the concepts of the invention can be used with virtually any other known type of psychograph which uses a principle of a primary member carrying at least one indicia and a secondary member which is capable of being moved to designate the indicia in order to express or convey a message or other communication. There are a number of subgeneric types of such psychographs.

Figure 4:
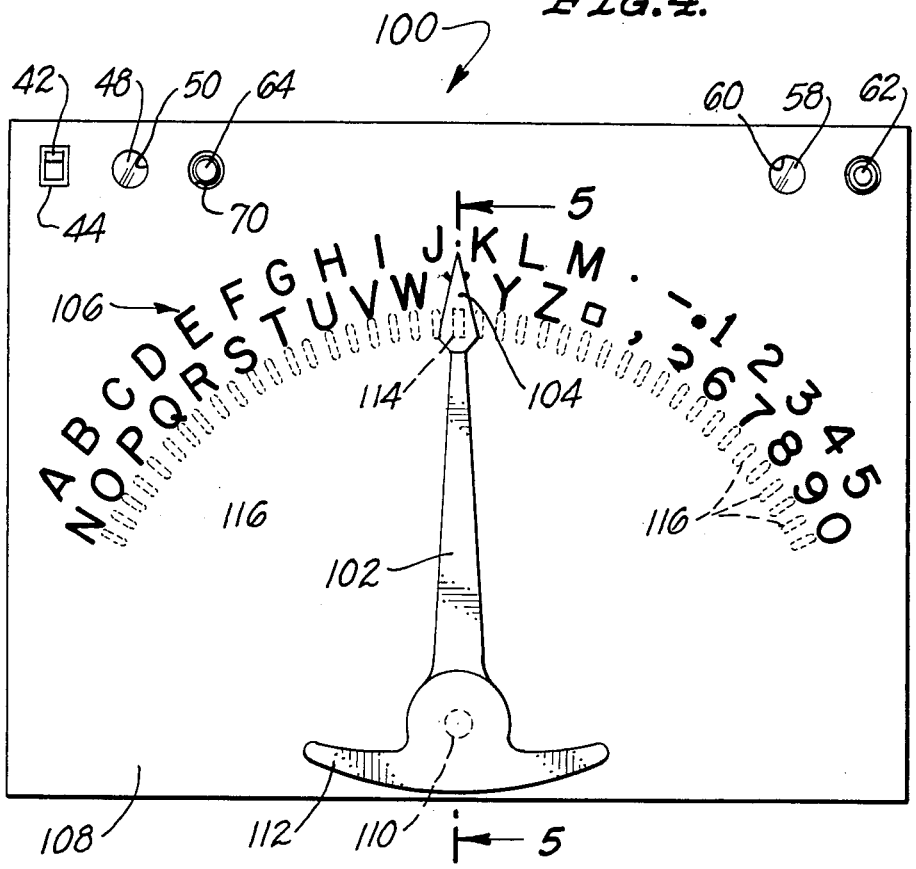
FIG. 4 is a view similar to FIG. 1 of different type of psychograph than the psychograph indicated in FIG. 1 constructed so as to use the concepts of this invention.
Figure 5:
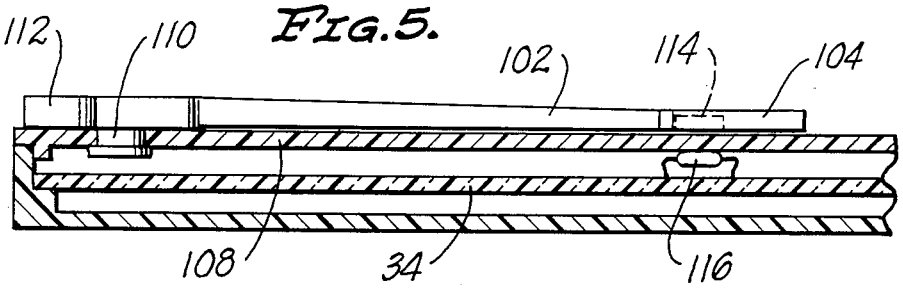
FIG. 5 is a partial cross-sectional view at an enlarged scale taken at line 5—5 in FIG. 4.

In FIGS. 4 and 5 there is shown a psychograph 100 of the type employing a rotatable pointer 102 so that an end 104 on it can be moved along a row 106 containing indicia as indicated in connection with the preceding discussion of the psychograph 10. This row 106 is located on a flat board 108; the pointer 102 is mounted on the board by a common pivot 110. An enlarged, comparatively short end 112 of the pointer is intended to be engaged by one or more hands of one or more users as the psychograph 100 is operated. As the pointer 102 is is rotated a magnet 114 on the end 104 closes switches 116 in the board 108 corresponding to the previously described switches 32.

These switches 116 are connected to circuit components as described in connection with the pssychograph 10. Under the circumstances no effort is being made to describe the use of the switches 116 or to describe the electronic components with which they are used. Various lights and switches as previously described which are normally visible are shown in FIG. 4 and are designed by the numerals previously used to designate such parts.

Figure 6:
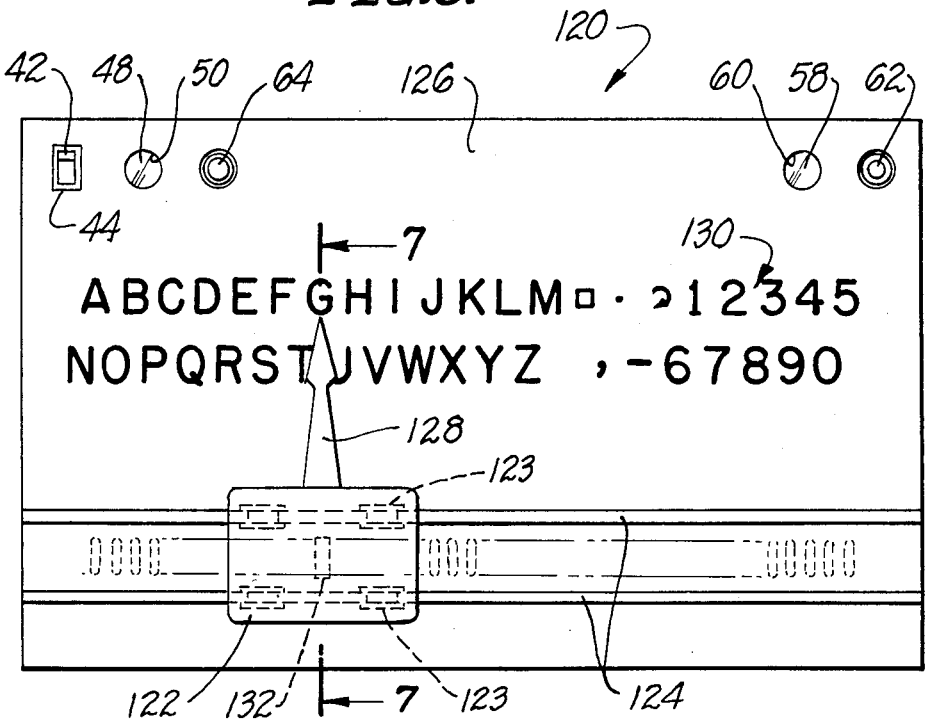
FIG. 6 is a view similar to FIG. 1 of another type of a psychograph than the psychographs indicated in the preceding figures constructed so as to use the concepts of this invention.
Figure 7:
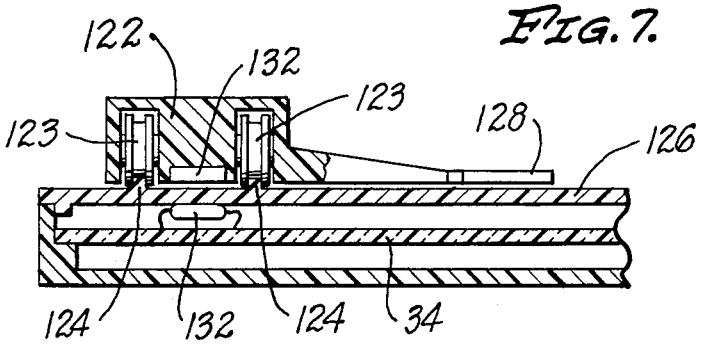
FIG. 7 is a partial cross sectional view at an enlarged scale taken at line 7—7 in FIG. 6.

In FIGS. 6 and 7 there is shown another psychograph 120 of a type employing an indicator 122 which can be linearly moved along on wheels 123 along tracks 124 located on a primary member or board 126. This indicator 122 may be provided with an extending pointer 128 which moves along a row 130 of indicia so as to designate various of these indicia as it is moved. A magnet 132 is located on the indicator 122 so as to close switches 134 corresponding to the various indicia in the row 130. These switches 134 correspond to the previously described switches 32, are located on the board 126 and are connected to circuit components as previously described in connection with the psychograph 10.

Because of this it is not considered necessary to either illustrate or discuss such circuit components. Those lights and switches corresponding to those previously described in connection with the psychograph 10 are shown in FIG. 6 and are designated in the this figure by the numerals previously used to designate them.

Although all of the psychographs, 10, 100 and 120 indicated in this specification have used magnetically operated switches as the switches 32, 116 and 134 it will be realized that other types of switches can be used provided that the indicator employed is constructed so that such other switches will be temporarily closed as the indicator is operated. It is even possible to employ photocells as switches with the present invention. The use of such other types of switches is not considered preferable because of design problems which are anticipated in connection with their use and because of possible reliability problems in connection with them.

I claim:

1. In a psychograph having a board, a plurality of visually apparent indicia located on said board and an indicator which is adapted to be moved relative to the surface of said board to designate successive of said indicia in order to express a communication in which the improvement comprises:

said visually apparent indicia including indicia representing the letters of the alphabet, punctuation means and a space between letters, a switch means located on said board in association with each of said visually apparent indicia, actuating means for sequentially closing individual of said switch means when a sequence of said visually apparent indicia are designated by said indicator, said actuating means being located on said indicator so as to be movable therewith, circuit means for providing a signal capable of being used to obtain a record of said visually apparent indicia designated by said indicator in the sequence in which said visually apparent indicia are designated, said circuit means being connected to all of said switch means, said indicator is freely movable on said board and is capable of being used to designate successive of said visually apparent indicia, said board has a concave shape and has an area whose depth is greater than the depth of the remainder of said board and said indicia representing a space is located in the area of the board having the greatest depth.

2. A psychograph as claimed in claim 1 wherein:

said area of greatest depth is located generally at the center of said board.

3. A psychograph as claimed in claim 1 including:

audible means for providing a noise when a signal is provided by said circuit means, said audible means forming a part of said circuit means, visible means for providing a visible signal when a signal is provided by said circuit means said visible means being a part of said circuit means, and said indicator is a transparent disk through which said visually apparent indicia are visible when they are covered by said indicator.

* * * * *